US005233165A

United States Patent [19]

Maumus et al.

[11] Patent Number: 5,233,165

[45] Date of Patent: Aug. 3, 1993

[54] ELECTRICAL HEATING RESISTANCE USING RESISTIVE ELEMENTS MADE OF CARBON/CARBON COMPOSITE MATERIAL

[75] Inventors: Jean-Pierre Maumus, Cenon; Henri Giret, Pessac, both of France

[73] Assignee: Societe Europeenne de Propulsion, Suresnes, France

[21] Appl. No.: 896,231

[22] Filed: Jun. 10, 1992

[30] Foreign Application Priority Data

Jun. 11, 1991 [FR] France ..... 91 07093

[51] Int. Cl.[5] ..... H05B 3/02; H05B 3/62

[52] U.S. Cl. ..... 219/539; 219/532; 219/553; 373/134; 373/132

[58] Field of Search ..... 219/539, 532, 553, 541; 373/132-134, 117; 338/294, 295, 319

[56] References Cited

U.S. PATENT DOCUMENTS

| | | | |
|---|---|---|---|
| 3,369,920 | 2/1968 | Bourdeau | 428/408 |
| 3,506,771 | 4/1990 | Cole | 373/128 |
| 4,126,757 | 11/1978 | Smith, Jr. et al. | 13/25 |
| 4,487,799 | 12/1984 | Galasso et al. | 428/408 |
| 4,490,828 | 12/1984 | Fukuhara et al. | 219/553 |
| 4,509,820 | 4/1985 | Murata et al. | 219/528 |

FOREIGN PATENT DOCUMENTS

| | | | |
|---|---|---|---|
| 0292781 | 3/1968 | Australia | 373/117 |
| 1491108 | 8/1967 | France . | |
| 2385060 | 10/1978 | France . | |
| 2463563 | 2/1981 | France . | |
| 2622381 | 4/1989 | France . | |
| 9102438 | 2/1991 | France . | |
| 1330851 | 4/1991 | U.S.S.R. . | |
| 1124151 | 8/1968 | United Kingdom . | |

OTHER PUBLICATIONS

Translation of Abstract of Foreign Patent Document SU 1330851 (SNOP VI), published Apr. 23, 1991.

*Primary Examiner*—Bruce A. Reynolds
*Assistant Examiner*—Michael D. Switzer
*Attorney, Agent, or Firm*—Weingarten, Schurgin, Gagnebin & Hayes

[57] ABSTRACT

The resistive elements are made up of strips of carbon/-carbon composite material that are interconnected by connection pieces that are likewise made of carbon/carbon composite material and that serve both for making electrical connections and for making mechanical connections between the strips. The strips and the connection pieces are assembled together at least in part by means of their shapes. The resistive elements may be coated in a layer of pyrocarbon.

8 Claims, 6 Drawing Sheets

ELECTRICAL HEATING RESISTANCE USING RESISTIVE ELEMENTS MADE OF CARBON/CARBON COMPOSITE MATERIAL

The present invention relates to an electrical heating resistance using resistive elements made of carbon/carbon (C/C) composite material.

The field of the invention is more particularly that of high-power heating resistances, typically having a power of 100 kW or more, such as those used for heating industrial furnaces, for example.

BACKGROUND OF THE INVENTION

At present, high power electrical heating devices use resistive elements made of metal or of graphite. Metal resistances are relatively heavy and they cannot be used at very high temperatures. Graphite resistances are lighter and they withstand higher temperatures, but they are very fragile.

To remedy these drawbacks, proposals have been made to make resistive elements of C/C composite material, i.e. a material comprising a reinforcing fiber texture made of carbon and densified by matrix that is also made of carbon. C/C composites combine high mechanical strength with thermal characteristics similar to those of graphite; they can be used at relatively high temperatures, e.g. up to about 1300° C. However, C/C materials are relatively expensive to manufacture.

Thus, an object of the invention is to provide an electrical heating resistance using resistive elements made of C/C composite material and designed in a manner that is optimized for reducing manufacturing costs as much as possible.

SUMMARY OF THE INVENTION

According to the invention, this object is achieved by the resistive elements being constituted by strips of carbon/carbon composite material that are interconnected by connection pieces also made of carbon/carbon composite material and providing both electrical connections and mechanical connections between the strips.

The bars and the connection pieces are assembled together, at least in part, by means of their shapes. The assembly may also include fasteners such as screws or screw-nut systems likewise made of carbon/carbon composite material.

In a preferred embodiment of the invention, the strips are disposed parallel to an axis about which they are distributed. The connection pieces comprise first pieces or "bars" for interconnecting the ends of strips that are diametrically opposite about the axis, second connection pieces or "connection blocks" for interconnecting side-to-side ends of adjacent strips, third connection pieces or "plates" for interconnecting end-to-end ends of aligned strips, and fourth connection pieces or current feeds for connecting the ends of the strips to current feed terminals.

Because of its modular design, the electrical resistance of the invention can be adapted to different powers while using the same basic components.

In addition, C/C composite materials are suitable for being machined into shapes such as dovetails without being made fragile, thus making it possible for the strips and the connection pieces to be assembled together, at least in part, by complementary shapes. Such assembly provides mechanical and electrical connections of good quality.

Finally, the mechanical properties of C/C composite materials are such that the elements of the resistance constitute simultaneously both resistive elements for heating and structural elements that impart the desired mechanical strength to the resistance as a whole without requiring a carrier structure.

The strips and the connection pieces are made of a composite material comprising a reinforcing fiber texture made of carbon and densified by means of a carbon matrix.

The reinforcing texture may be of the two-dimensional (2D) type, or of the three-dimensional (3D) type.

A 2D texture is made up of superposed layers. These may be one-dimensional layers (e.g. sheets of mutually parallel cables or threads) or they may be two-dimensional layers, e.g. pieces of cloth.

A 3D texture has fibers extending in at least three different non-coplanar directions. By way of example, a 3D texture may be formed by three-dimensional weaving, or by superposing two-dimensional layers that are interconnected by needling or by implanting threads.

The reinforcing texture is densified with its carbon matrix in a manner that is known per se, either by using a liquid or by using a gas. Densification by means of a liquid consists in impregnating the fiber texture with a precursor of carbon, such as a resin, which is then polymerized and pyrolyzed. Several impregnation-polymerization-pyrolysis cycles may be required to obtain the desired degree of densification. Densification by means of a gas consists in forming the carbon matrix by chemical vapor infiltration.

The resistive strips may be cut out from slabs of prefabricated C/C composite material, while the connection pieces are machined from blanks or from solid blocks of carbon/carbon composite material. When the reinforcing texture of the composite material constituting the strips is made of superposed layers, then the layers are disposed parallel to the faces of the slabs from which the strips are cut out.

After machining, the strips and the connection pieces making up a resistance are advantageously coated with a layer of pyrocarbon. This layer is made by chemical vapor deposition on the strips and on the connection pieces, preferably before they are assembled together.

Tests have shown that resistive elements coated in pyrocarbon have improved lifetime and behavior. In particular, resistive elements that re not coated in pyrocarbon deteriorate more quickly. In addition, if there is no pyrocarbon coating, the operation of the resistive elements is affected by the presence of fingerprints due to handling; this no longer happens if a pyrocarbon coating is present.

BRIEF DESCRIPTION OF THE DRAWINGS

Embodiments of the invention are described by way of example with reference to the accompanying drawings, in which.

DETAILED DESCRIPTION

Figure 1:
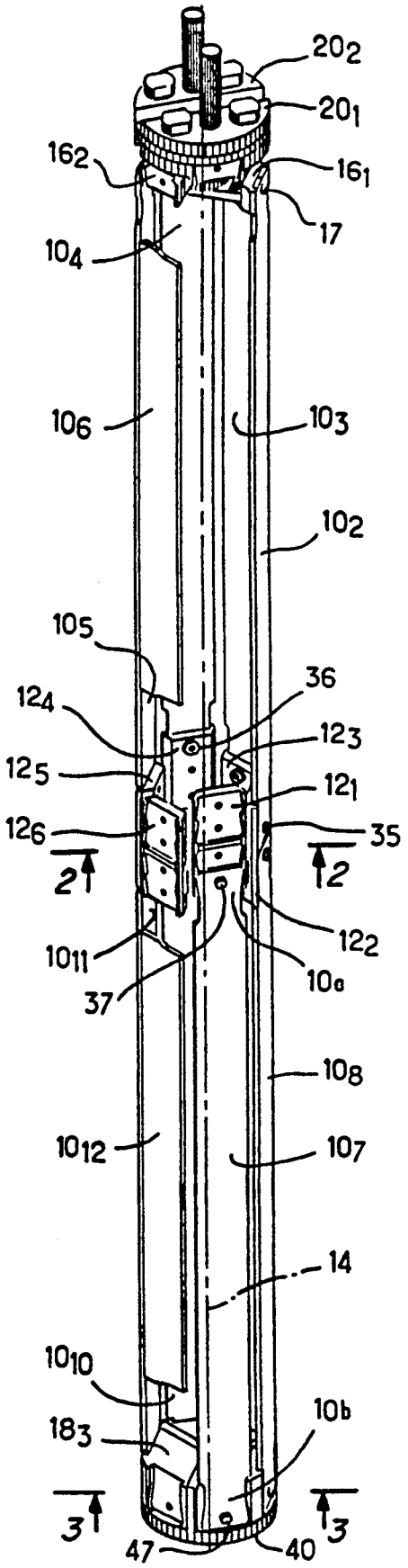
FIG. 1 is a perspective view of a first embodiment of an electrical heating resistance of the invention.
Figure 3:
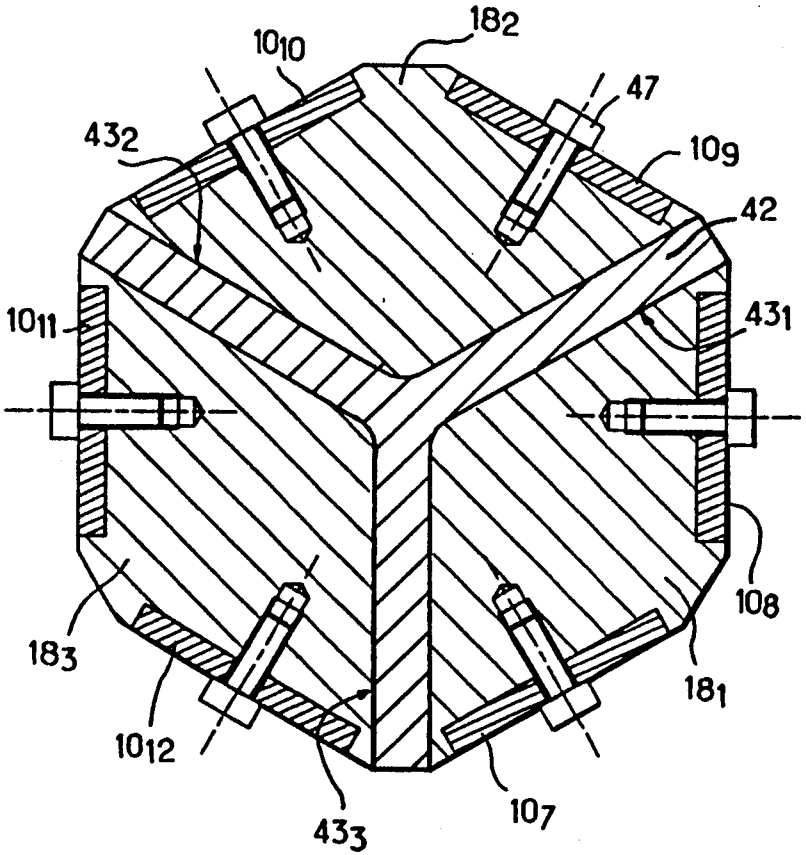
FIG. 3 is a section view on plane III—III of FIG. 1.
Figure 2:
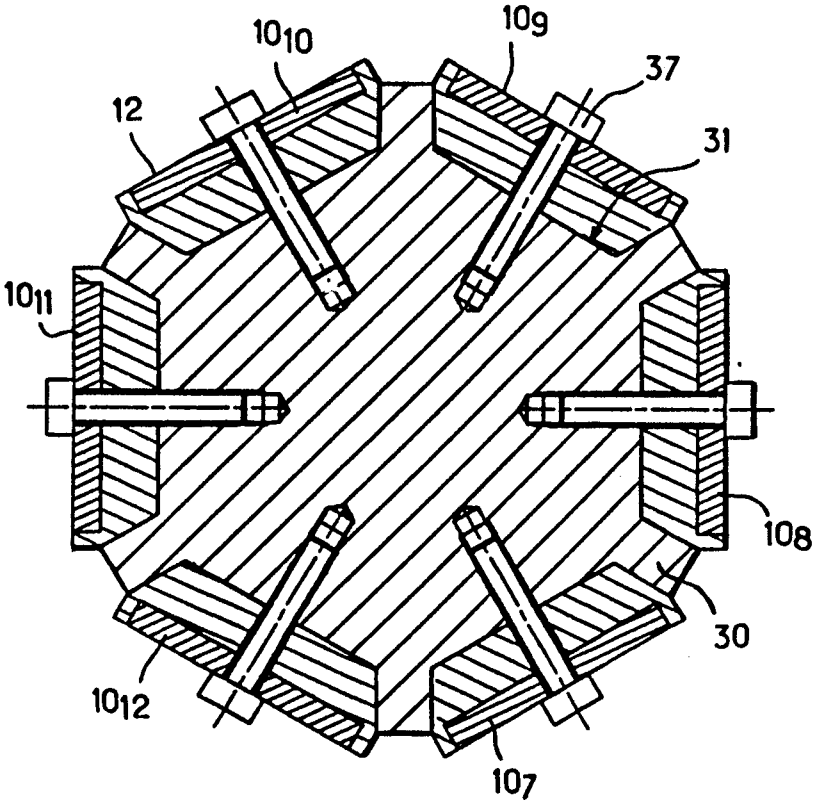
FIG. 2 is a section view on plane II—II of FIG. 1.

The heating resistance shown in FIGS. 1 to 3 comprises twelve flat unit strips $10_1$ to $10_{12}$ of rectangular section (partially cutaway in FIG. 1). The strips $10_1$ to $10_{12}$ are identical and are distributed as a first group of strips $10_1$ to $10_6$ and a second group of strips $10_7$ to $10_{12}$. The strips in both groups are angularly distributed about a common axis 14 and all of the strips lie parallel thereto. Each of the strips $10_1$ to $10_6$ in the first group is alignment with a corresponding strip $10_7$ to $10_{12}$ in the second group, and is electrically connected thereto by means of a corresponding connection plate $12_1$ to $12_6$. At their opposite ends, two of the strips in the first group ($10_1$ and $10_4$) are connected to respective current feeds $20_1$ to $20_2$, while the other four strips are interconnected in pairs by means of respective radial bars $16_1$ to $16_2$, and at their opposite ends, the strips in the second group are interconnected in pairs by means of connection blocks $18_1$ to $18_3$.

Figure 4:
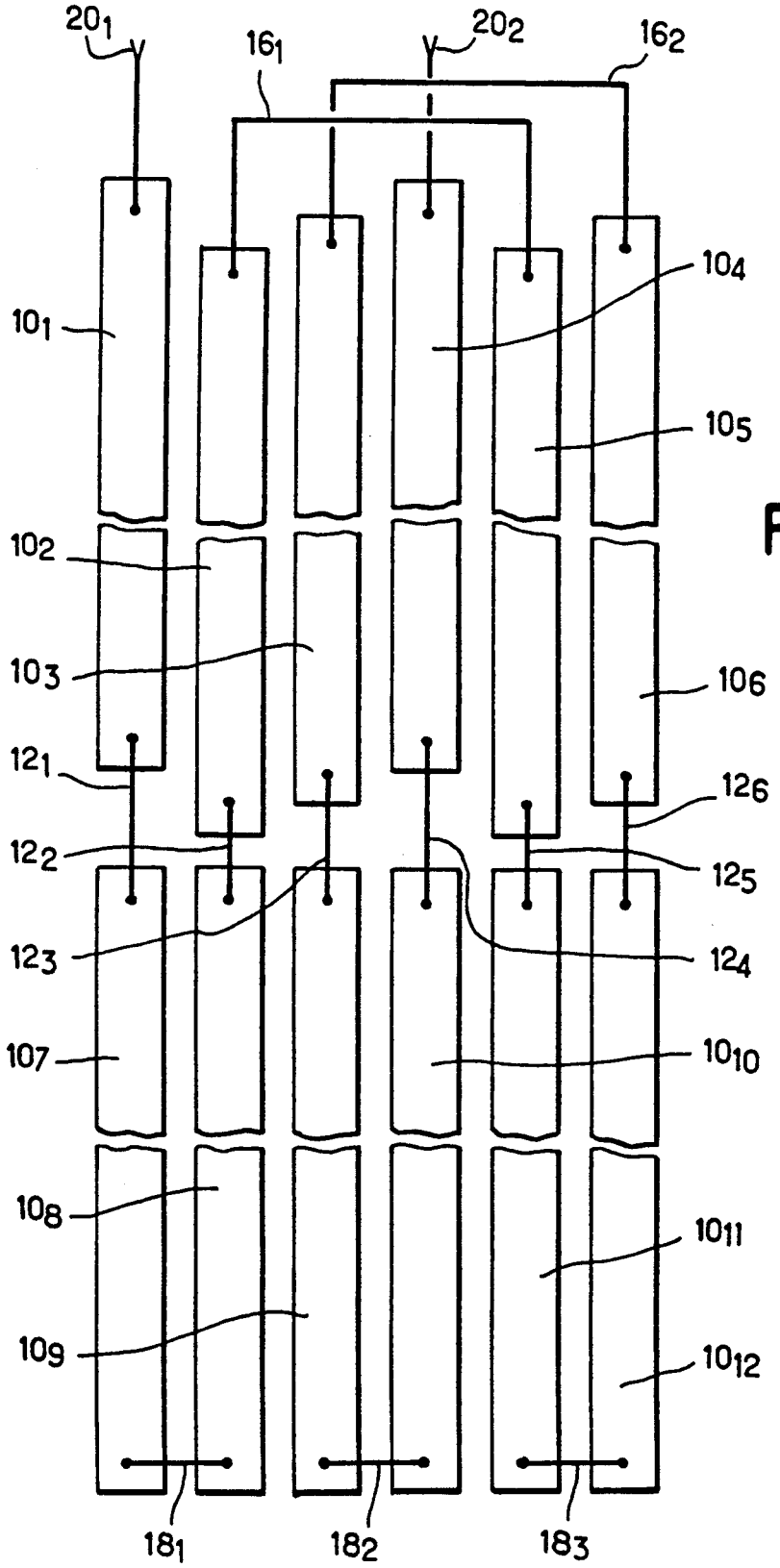
FIG. 4 is a diagram showing the electrical connections between the strips of the heating resistance.

As can be seen in FIG. 4, current flows between the current feeds $20_1$ and $20_2$ successively via: strip $10_1$; strip $10_7$ in alignment therewith and connected thereto by plate $20_1$; strip $10_8$ adjacent to strip $10_7$ and connected thereto by connection block $18_1$; strip $10_2$ in alignment with strip $10_8$ and connected thereto by plate $12_2$; strip $10_5$ opposite to strip $10_2$ and connected thereto by bar $16_1$; strip $10_{11}$ in alignment with strip $10_5$ and connected thereto by plate $12_5$; strip $10_{12}$ adjacent to strip $10_{11}$ and connected thereto by connection block $18_3$; strip $10_6$ in alignment with strip $10_{12}$ and connected thereto by plate $12_6$; strip $10_3$ opposite to strip $10_6$ and connected thereto by bar $16_2$; strip $10_9$ in alignment with strip $10_3$ and connected thereto by plate $12_3$; strip $10_{10}$ adjacent to strip $10_9$ and connected thereto by connection block $18_2$; and strip $10_4$ in alignment with strip $10_{10}$ and connected thereto by plate $12_4$.

Each strip 10 is of constant width along its entire length with the exception of its ends 10*a* and 10*b* which are shaped identically into dovetails.

Figure 5:
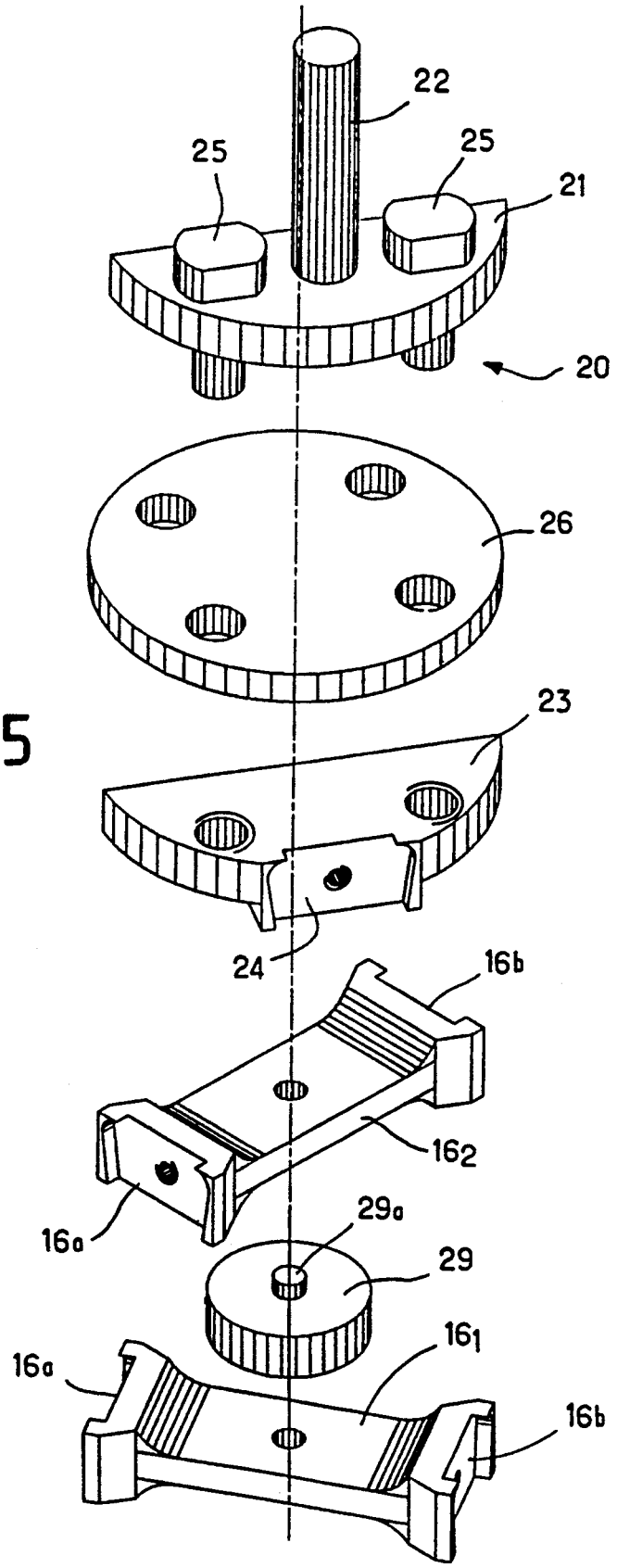
FIG. 5 is an exploded perspective view of the items at one of the ends of the resistance that enable the ends of the strips to be interconnected and to be connected to current feeds.

FIG. 5 is an exploded view of end connection pieces (top endpieces in FIG. 1) between the bars $10_1$ to $10_6$ and the current feeds.

Each current 20 comprises: a first piece 21 fixed to a terminal 22 suitable for connection to an electrical conductor by means of a connector; and a second piece 23 provided with a recess 24 that is dovetail-shaped and complementary to the dovetail shapes formed at each end of a strip 10. The piece 21 is connected to the piece 23 by means of screws 25 passing through holes formed in an insulating disk 26. This disk is interposed between the pieces 21 and 23 of each current feed. The end of a strip is assembled in its recess 24 by being fitted therein radially relative to the axis 14. Such mutually-engaging shape assembly is secured by means of a screw (not shown) that passes through the end of the strip and is screwed into a tapped hole formed in the center of the recess 24.

The opposite ends of each bar 16 have respective recesses 16*a* and 16*b* that are analogous to the recesses 24 and suitable for connection to the ends of the strips 10. These ends are secured to the strips by means of screws 17 analogous to the screws 27, with each screw 17 passing through the end of a corresponding strip and being received in a tapped hole formed in the center of the corresponding recess 16*a* or 16*b*.

An insulating washer 29 is interposed between the bars $16_1$ and $16_2$ in order to prevent them coming into contact with each other. The insulating washer 29 is provided with a centering peg 29*a* which penetrates into one of two orifices formed in the middles of the bars $16_1$ and $16_2$. In the example shown, the bars $16_1$ and $16_2$ are wider at their ends where they are formed with the recesses suitable for receiving the ends of the strips together with the screws 17.

Figure 6:
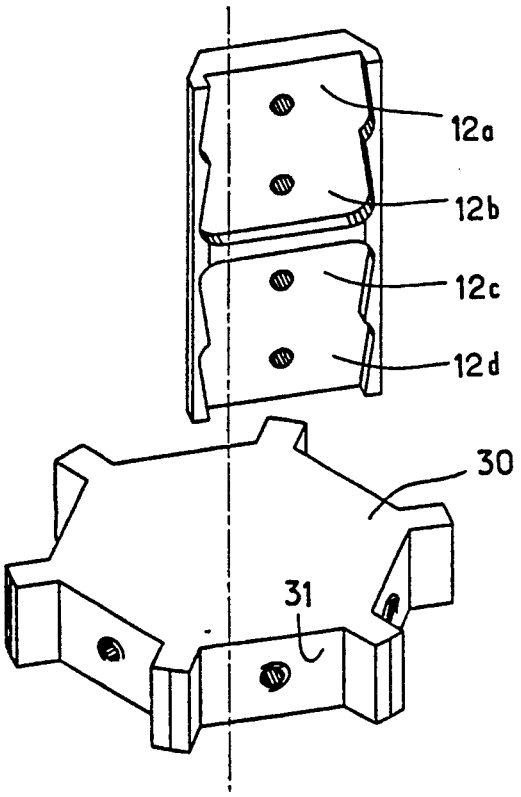
FIG. 6 is an exploded perspective view of an insulating support and a connection plate for interconnecting strips that are in end-to-end alignment.

FIG. 6 shows one of the connection plates 12 and a support piece 30 made of insulating material for interconnecting the ends of adjacent strips $10_1$ to $10_6$ to the corresponding ends of strips $10_7$ to $10_{12}$. At one end, each connection plate 12 has two dovetail recesses 12*a* and 12*b* that are offset in the axial direction, and symmetrically, at its opposite end, it has two other recesses 12*c* and 12*d* that are also offset in the axial direction. Each of the recesses 12*a*, 12*b*, 12*c*, and 12*d* is complementary in shape to the end of a strip 10. The support piece 30 is hexagonal in shape and it has recesses 31 that are uniformly distributed around its periphery, each receiving a connection plate 12. Each plate 12 is engaged in the corresponding recess 31 with its own recesses 12*a* to 12*d* facing outwards.

The top ends of the strips $10_7$ to $10_{12}$ are connected to the plates $12_1$ to $12_6$ and to the insulating piece 30 by engagement in the recesses 12*c* or 12*d* and by screws 37 (FIGS. 1 and 3) which pass through the ends of the strip, passing through a hole formed in the middle of the corresponding recess 12*c* or 12*d*, and screwed into tapped holes formed in the piece 30 in the middle of each of its recesses 31. The bottom ends of the strips $10_1$ to $10_6$ are connected to the plates $12_1$ to $12_6$ by engaging in the recesses 12*a* or 12*b* and by means of screws 35 (FIG. 1) which pass through the ends of the strips, which pass through respective holes formed in the centers of the corresponding recesses 12*a* or 12*b*, and which are secured by nuts 36 (FIG. 1).

Because of the different axial offsets between the current feed pieces 23 connected to the strips $10_1$ and $10_4$ and either the bar $16_1$ connected to the strips $10_2$ and $10_5$ or the bar $16_2$ connected to the strips $10_3$ and $10_6$, the bottom ends of the bars $10_1$ to $10_6$ are at three different levels. However, the top ends of the bars $10_7$ to $10_{12}$ are at all the same level, namely that of the support piece 30. The plates $12_1$ to $12_6$ serve to allow for the different distances between the facing ends of the strips that they interconnect. A first offset can be taken up by disposing the plate with its recess 12*c* or its recess 12*d* level with the piece 31 (as applies respectively to plates $12_2$, $12_3$, $12_5$, and $12_6$, and to the plates $12_1$ and $12_2$). A second offset can be taken up by engaging the bottom ends of the strips $10_1$ to $10_6$ in recess 12*a* or in recess 12*b* (as applies, respectively, to strips $10_1$, $10_2$, $10_4$, and $10_5$, and to strips $10_3$ and $10_6$).

Figure 7:
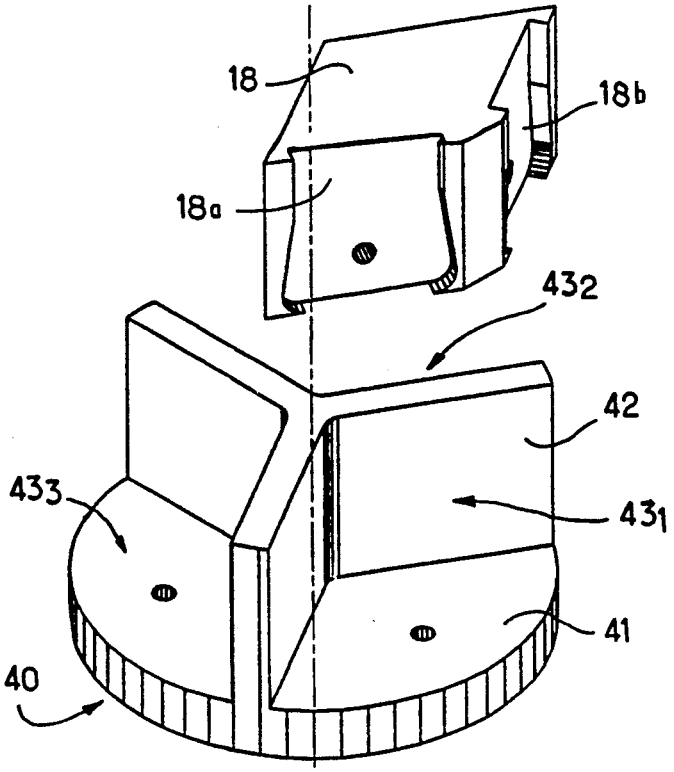
FIG. 7 is an exploded perspective view of an insulating support and a connection block enabling the side-by-side ends of adjacent strips to be interconnected at an opposite end of the resistance.

FIG. 7 shows one of the connection blocks 18 and a support piece 40 of insulating material that is used for connecting together and assembling the bottom ends of the strips $10_7$ to $10_{12}$. The piece 40 comprises a base 41 having walls 42 projecting therefrom to delimit three recesses $43_1$, $43_2$, and $43_3$ that are angularly distributed around the axis 14 and that are insulated from one another. Each recess $43_1$, $43_2$, and $43_3$ receives a respective connection block. Each connection block is intended to interconnect the bottom ends of two adjacent strips. To this end, a block 18 has two recesses 18*a* and 18*b* of dovetail-shape complementary to the shape of the end of a strip. The end of a strip is assembled to a block 18 by engaging its end in a radial direction in a recess 18*a* or 18*b*, and by fixing it there by means of a screw 47 which passes through the end of the strip and which is screwed into a tapped hole formed in the center of the recess.

It may be observed that by assembling together the ends of the strips and the various connection pieces by using a dovetail assembly technique, it is possible to maintain satisfactory electrical contact even in the event of the fastening screws becoming loose.

The various insulating pieces, namely the disk 26, the washer 19, and the support pieces 30 and 40, may be made of ceramics, for example.

The strips and the various pieces that interconnect them are made of carbon/carbon composite material.

Carbon/carbon composite materials are known and are used, in particular, because of their thermostructural properties, i.e. because of their ability to constitute structural components given their good mechanical strength, and to retain said properties up to temperatures that are relatively high.

Carbon/carbon composite materials are made of a carbon reinforcing texture that is densified by means of a matrix of carbon.

In particular, to make the strips 10, it is possible to use a two-dimensional (2D) reinforcing texture made of carbon fibers formed in one-dimensional or two-dimensional layers that are stacked flat parallel to the faces of the strips. One-dimensional layers are constituted, for example, by sheets of mutually parallel cables or threads, in which case the longitudinal direction of the strips is parallel to the cables or threads. Two-dimensional layers may be pieces of cloth, for example.

The fiber reinforcing texture is densified by means of a liquid or by means of a gas. Both of these methods are known per se.

Densification by means of a liquid consists in impregnating the fiber texture by means of a carbon precursor, such as a resin or a slip that leaves a carbon residue after polymerization and pyrolysis. Impregnation may be performed on the layers (cloth, or sheets of threads) before they are superposed. Preimpregnated layers may be shaped by means of a press so as to obtain a desired fiber density by compacting (where "fiber density" is the percentage of the volume within the material that is actually occupied by its fibers). In order to obtain a satisfactory degree of densification, several successive impregnation-polymerization-pyrolysis cycles may be necessary.

Densification by means of a gas consists in forming the matrix by chemical vapor infiltration. To this end, the texture is placed in an oven in which a flow of gas is admitted under determined conditions of temperature and pressure that allow carbon to be deposited within the accessible pores of the texture. The gas flow is typically constituted by a hydrocarbon or by a mixture of hydrocarbons. At least until it is consolidated, the fiber texture may be held in shape in tooling which also ensures the degree of compacting that is required for obtaining the desired fiber density. The tooling is dismantled once the texture is consolidated, i.e. once the pyrocarbon deposit is sufficient for bonding the fibers together. Chemical vapor infiltration is continued until the desired degree of densification is achieved.

For obvious reasons of economy, the strips 10 are manufactured by making slabs or carbon/carbon material from which the strips are subsequently cut out.

After machining, the strips are coated with a layer of pyrolytic carbon or "pyrocarbon". This is performed by chemical vapor deposition under conditions similar to those for chemical vapor infiltration of the carbon. The thickness of the pyrocarbon layer may be equal to about 100 microns.

When making the connection pieces, namely the bars $16_1$ and $16_2$, the plates $12_1$ to $12_6$, and the blocks $18_1$ to $18_3$, and also when making the current feeds, namely the pieces 21 and 23, the screws 17, 27, 35, 37, 47, and the nuts 36, a carbon/carbon material is used which preferably includes a three-dimensional (3D) reinforcing texture. Such a texture is obtained, for example, by three-dimensional weaving of carbon threads, or by superposing one-dimensional or two-dimensional layers and by interconnecting the layers. When using one-dimensional layers, such as superposed sheets of cables, the cable directions differ from one sheet to another. In conventional manner, the connection between superposed layers may be formed by needling or by implanting threads. When needling is used, the fibers entrained by the needles may be taken from webs of fibers interposed between the layers.

The three-dimensional texture is densified either by means of a liquid or by means of a gas as described above.

The connection pieces are machined in blocks of carbon/carbon material. After machining, they may be coated with a pyrocarbon coating, like the strips.

It is also possible to use a 3D reinforcing texture for making the strips and a 2D reinforcing texture for making the connection pieces.

The use of carbon/carbon composite material is particularly advantageous since it makes it possible to obtain an electrical heating device in which the resistive elements, in particular the strips, also constitute structural elements because they are strong and not fragile. In addition, carbon/carbon composite materials are light, having a relative density of about 1.7, and they are capable of withstanding high temperatures, e.g. as high as 2500° C. in a non-oxidizing atmosphere.

According to another characteristic of the device of the invention, and because of the mechanical properties of the material used, the connections between the resistive elements are made by means of pieces that serve not only to provide electrical connection but also to provide mechanical connection. In particular, as described above, it is possible to achieve assembly by interfitting shapes which ensure both functions: electrical assembly and mechanical assembly.

Finally, as already mentioned, the pyrocarbon coating on the resistive elements and on the connection pieces can improve the lifetime and the operation of the resistance. The coating may be renewed after a certain length of use.

EXAMPLE

A heating device for use at a power of 250 kW and as shown in FIG. 1 has been manufactured.

The strips 10 were cut out from a slab of composite material comprising a fiber texture formed by stacking pieces of carbon cloth having a fiber density of 25% and a carbon matrix formed by chemical vapor infiltration. Infiltration was continued until the residual porosity was about 15%. The resulting material had a relative density of about 1.7. Each strip was 5 mm thick, 50 mm wide, and 750 mm long. These dimensions may be adapted to match the desired power.

The connection pieces (the current feeds, the plates, the bars, the blocks, the screws, and the nuts) were machined in blocks of composite material comprising a fiber texture formed by stacking and needling pieces of carbon cloth alternating with webs of carbon fibers, giving a fiber density of about 25%. The texture was densified by pyrocarbon vapor infiltration until a residual porosity of about 15% was achieved. The resulting material had a relative density of about 1.7

In the embodiment described above, the resistive elements are formed by twelve strips distributed in two groups of six.

Because of its modular design, the heating device can be adapted to different powers or to different configurations in use, by providing a larger or a smaller number of strips.

In particular, one or more additional groups of six strips can be added to the device of FIG. 1 by using one or more additional sets of plates and insulating pieces similar to the set constituted by the plates $\mathbf{12}_1$ to $\mathbf{12}_6$ and the piece 30.

Figure 8:
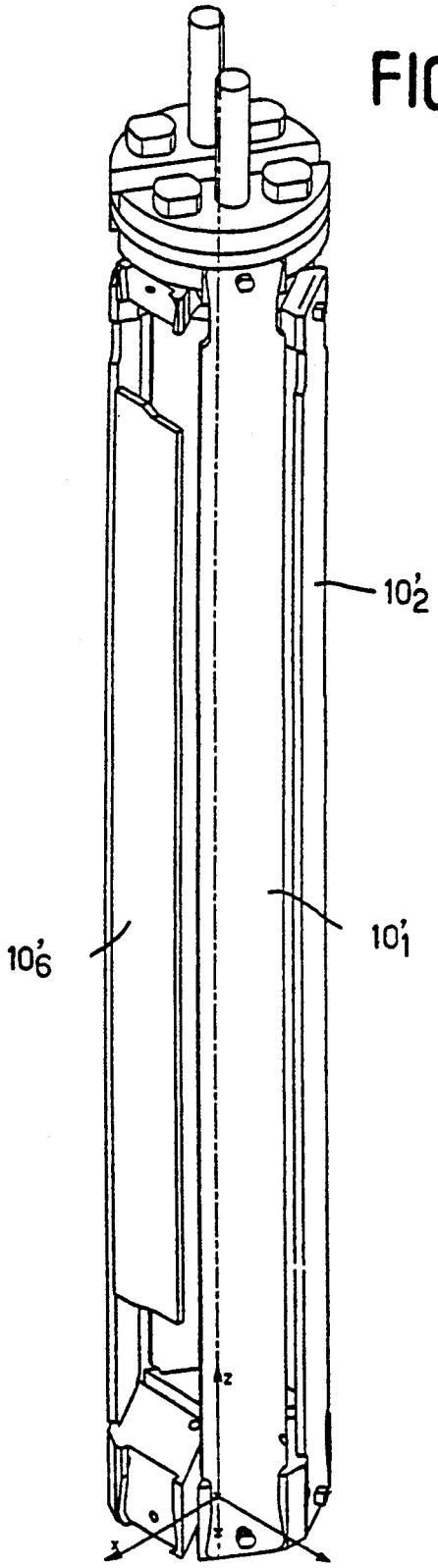
FIG. 8 is a diagrammatic perspective view showing a second embodiment of a resistance of the invention.

As shown in FIG. 8, it is also possible to make a heating device in which the resistive elements are constituted by a group of strips $\mathbf{10'}_1$ to $\mathbf{10'}_6$ in which each strip runs from one end of the device to the other. If connection pieces identical to those used at the ends of the heating device shown in FIG. 1 are used in this case, then it is necessary to provide strips that are of different lengths in order to compensate for the offsets between their top ends.

Figure 9:
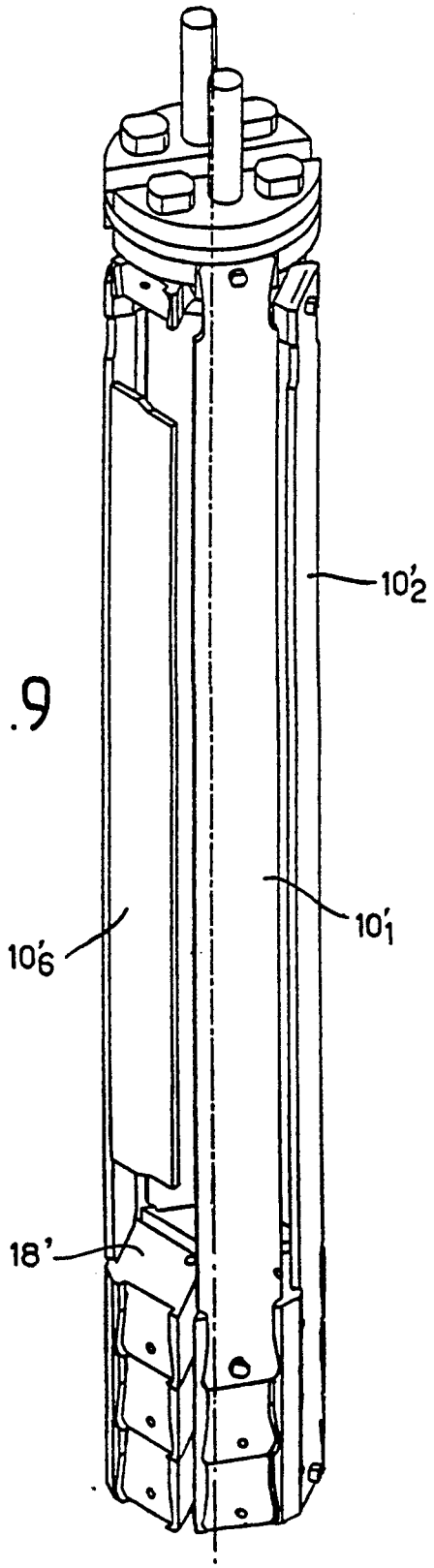
FIG. 9 is a diagrammatic perspective view showing a third embodiment of a resistance of the invention.

In variant, as shown in FIG. 9, instead of using strips of different lengths, the offsets between the top ends of the strips $\mathbf{10'}_1$ to $\mathbf{10'}_6$ can be compensated by using connection blocks 18' that have assembly positions at three different levels for engaging each strip end.

We claim:

1. A high power electrical heating resistance comprising resistive elements constituted by strips of carbon/carbon composite material, and connection pieces also made of carbon/carbon composite material and interconnecting said strips to provide both electrical connections and mechanical connections between the strips, wherein the strips are disposed parallel to an axis about which they are distributed and the connections between the strips at one end of the resistance are made by means of connection pieces which extend radially to interconnect the ends of strips that are diametrically opposite about the axis.

2. A high power electrical heating resistance according to claim 1, wherein the connections between the strips at an end of the resistance opposite to said one end are made by means of connection pieces which interconnect side-by-side ends of adjacent strips.

3. A high power electrical heating resistance according to claim 1, wherein the strips and the connection pieces are assembled together at least in part by means of their shapes.

4. A high power electrical heating resistance according to claim 2, wherein the strips and the connection pieces are further assembled by fasteners made of carbon/carbon composite material.

5. A high power electrical heating resistance according to claim 1, wherein the strips and connection pieces are coated with a layer of pyrolytic carbon.

6. A high power electrical heating resistance according to claim 1, comprising a plurality of sets of aligned strips extending parallel to the axis between one end of the resistance and an opposite end thereof, and including connection pieces interconnecting the end-to-end ends of strips that are in alignment.

7. A high power electrical heating resistance according to claim 6, wherein each connection piece for interconnecting the end-to-end ends of aligned strips includes a plurality of recesses each suitable for receiving the end of a strip, which recesses are spaced apart from one another parallel to the axis in order to accommodate at least one of the strips connected to said connection piece in different longitudinal position.

8. A high power electrical heating resistance comprising resistive elements constituted by strips of carbon/carbon composite material, and connection pieces also made of carbon/carbon composite material and interconnecting said strips to provide both electrical connections and mechanical connections between the strips, wherein the strips and the connection pieces are assembled together by means of their shapes and by means of fasteners made of carbon/carbon composites, each strip having an end portion shaped into a dovetail engaged in a recess of corresponding dovetail shape formed in a connection piece, whereby continuity of the electrical connection is ensured by said dovetail engagements even in case of loosening of the fasteners.

* * * * *

UNITED STATES PATENT AND TRADEMARK OFFICE

CERTIFICATE OF CORRECTION

PATENT NO. : 5,233,165

DATED : August 3, 1993

INVENTOR(S) : Jean-Pierre Maumus, et al

It is certified that error appears in the above-indentified patent and that said Letters Patent is hereby corrected as shown below:

Column 2, line 50, "that re" should read --that are--.

Column 3, line 29, "$20_1$ to $20_2$" should read --$20_1$ and $20_2$--.

Column 3, line 30, "$16_1$ to" should read --$16_1$ and--.

Column 7, line 11, "Each strip was" should read --Each strip 10 was--.

Column 7, line 22, "1.7" should read --1.7.--.

Signed and Sealed this

Nineteenth Day of July, 1994

Bruce Lehman

*Attest:*

BRUCE LEHMAN

*Attesting Officer*

*Commissioner of Patents and Trademarks*